United States Patent [19]

Sherman et al.

[11] 4,127,620

[45] Nov. 28, 1978

[54] INTEGRAL WATER FILL SYSTEM FOR HUMIDIFIERS

[75] Inventors: John A. Sherman; Peter S. Wardell, both of Orangeville, Canada

[73] Assignee: Canadian Appliance Manufacturing Company Limited, Weston, Canada

[21] Appl. No.: 816,367

[22] Filed: Jul. 18, 1977

[51] Int. Cl.[2] ..... B01F 3/04

[52] U.S. Cl. ..... 261/26; 261/92

[58] Field of Search ..... 261/26, 92, DIG. 15, 261/DIG. 41, DIG. 46, 35, 24, 30; 55/528

[56] References Cited

U.S. PATENT DOCUMENTS

| | | | |
|---|---|---|---|
| 2,210,354 | 8/1940 | Bates | 261/92 X |
| 2,343,820 | 3/1944 | Thornton | 261/92 X |
| 2,939,687 | 6/1960 | Goettl | 261/26 |
| 3,047,994 | 8/1962 | Le Brun | 261/DIG. 41 |
| 3,171,820 | 3/1965 | Volz | 55/528 X |
| 3,274,992 | 9/1966 | Martin | 261/DIG. 15 |
| 3,596,886 | 8/1971 | Trautman | 261/92 |
| 3,598,370 | 8/1971 | Hoag | 261/26 |
| 3,739,597 | 6/1973 | Schulze, Sr. | 261/92 X |

FOREIGN PATENT DOCUMENTS

| | | | |
|---|---|---|---|
| 283,028 | 1/1928 | United Kingdom | 261/92 |

*Primary Examiner*—Richard L. Chiesa
*Attorney, Agent, or Firm*—R. A. Eckersley

[57] ABSTRACT

In a portable domestic air humidifier of the rotating drum type, the improvement wherein a fill funnel occupies a portion of the periphery of the drum.

11 Claims, 6 Drawing Figures

INTEGRAL WATER FILL SYSTEM FOR HUMIDIFIERS

This invention relates to improvements in air humidifiers particularly of the domestic portable type wherein a belt of water absorbent filter material is supported upon the periphery of a rotatable drum.

In air humidifiers of the aforesaid type the water is contained in a reservoir which may be of some 5–10 gallons capacity. During winter periods when the ambient air has a low relative humidity the reservoir may need to be replenished at least daily. Replenishment is normally accomplished either from the top, front, or side of the humidifier, or by removal of the reservoir at least partially from the encasement of the humidifier whereby water can be poured directly into it. Such methods generally necessitate the removal of the rotatable drum from the encasement. It can be appreciated that the filter material of the drum may be saturated with water, hence a user will have to provide a recipient for the drum when it is removed. In a still further method of replenishment, a funnel is affixed within the encasement of the humidifier and a hose leading therefrom directed towards the reservoir. The hose tends to restrict water flow unnecessarily, and it is often found that fill water spills from the funnel down the sides of the encasement.

We have found that a funnel arrangement can be constructed so as to occupy a portion of the periphery of the drum of the humidifier. Such construction has numerous advantages. Assuming the drum to be rotated so that the mouth of the funnel is uppermost, water discharged from the spout of the funnel is directed centrally into the reservoir, and the interior surfaces of the drum tend to contain any splashing. The spout of the funnel does not therefore need to be elongated, and it forms little restriction to the flow of feed water. Such water as may overflow from the mouth of the funnel tends to be directed by the exterior surfaces of the drum towards the reservoir. In use the fill system is found to be rapid and virtually splash free. Constructional advantages are also to be gained. Thus it is no longer found necessary to seal the peripheral edge of the reservoir to the encasement of the humidifier, as splashing and misdirected water are not in evidence. Also, in a preferred embodiment, the fill funnel coacts with peripheral portions of the drum to retain the filter belt in position thereon.

Briefly expressed, our invention comprises, in a portable air humidifier as previously described including a drum having a skeletal frame periphery, a belt of air permeable, water absorbent material generally covering the drum periphery, the improvement wherein a major portion of the periphery is covered by the belt and wherein the remaining minor portion is bounded by wall structure defining the mouth opening of a funnel. The funnel wall structure further defines a discharge spout, the spout being directed towards the interior of the drum.

In a preferred embodiment the funnel is generally wedge shaped in the form of a truncated rectangular pyramid. The skeletal periphery of the drum is formed by a plurality of axially aligned, equi-spaced rods, the funnel being proportioned so as to enter into loose, wedging engagement with an adjacent pair of rods when positioned. Still further desirably, shoulder means are provided on the funnel which engage behind the rods. The ends of the water absorbent filter material are nipped between respective wedging portions of the funnel and the rods to secure the filter to the drum.

Our invention, together with such further aims, objects and advantages thereof as will be apparent, will be more fully described in relation to a preferred, illustrated embodiment. In the accompanying figures, FIG. 1 shows in perspective the drum of a humidifier constructed in accordance with our invention FIG. 2 shows in detail the drum of FIG. 1 with the novel fill funnel of our invention removed;

Figure 4:
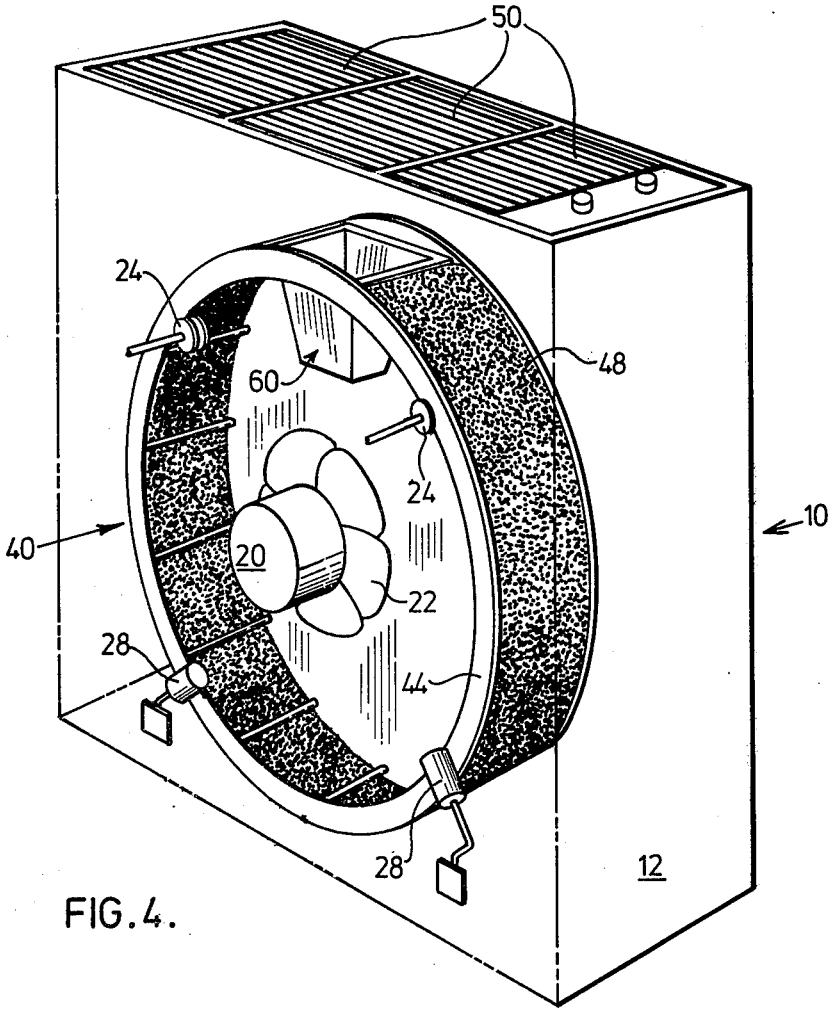
FIG. 4 shows in perspective an air humidifier encasement with the drum of FIG. 1 in a mounted position therein.
Figure 5:
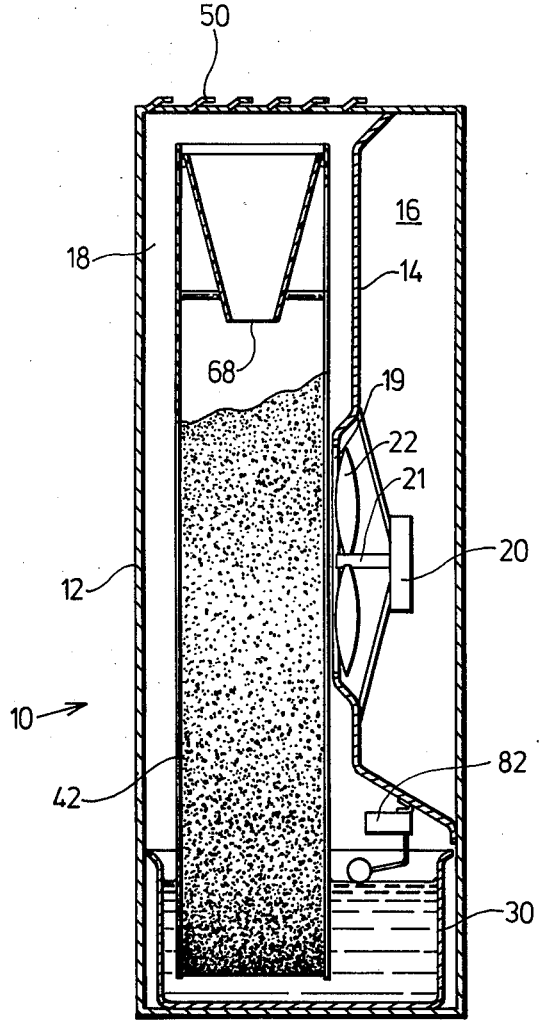
FIG. 5 shows the humidifier of FIG. 4 in end elevation, partially broken away and partially in section.

Referring first to FIGS. 4 and 5, a humidifier is indicated generally by the numeral 10, and comprises an outer encasement 12, an inner baffle wall 14 sealed to interior surfaces of the encasement thereby forming an air inlet chamber 16 and an air outlet plenum 18. Baffle wall 14 is omitted from FIG. 4 for the purpose of clarity. Chamber 16 and plenum 18 are interconnected by a venturi opening 19 formed in baffle wall 14. Air propelling means comprising an electric motor 20 having a drive shaft 21 and fan blades 22 secured to the drive shaft is mounted within air inlet chamber 16 on baffle wall 12 concentrically with venturi opening 19.

Within plenum 18 is mounted a drum 40, which comprises a back wall 42, a front annular flange 44, the flange and back wall being interconnected by a plurality of spaced apart rods 46 which form a skeletal framework. A band of air pervious water absorbent material 48 is supported on rods 46. Band 48 is typically an open cell polyurethane such as described in U.S. Pat. No. 3,171,820 dated Mar. 2, 1965 to Volz. Drum 40 is suspended on two upper pulley wheels 24 which engage the edge of flange 44, and two lower rollers 28 which bear against the side of flange 44 to retain drum 40 in a vertical plane. At least one of pulley wheels 24 is driven so as to cause drum 40 to rotate. The motive source for driving pulley wheel 24 may be motor 20, through a belt and pulley reduction gear for example, or it may comprise a separate motor. The lower portions of drum 40 pass through a water reservoir 30 positioned in the bottom of encasement 12. Reservoir 30 is not shown in FIG. 4 for the purpose of clarity.

Figure 1:
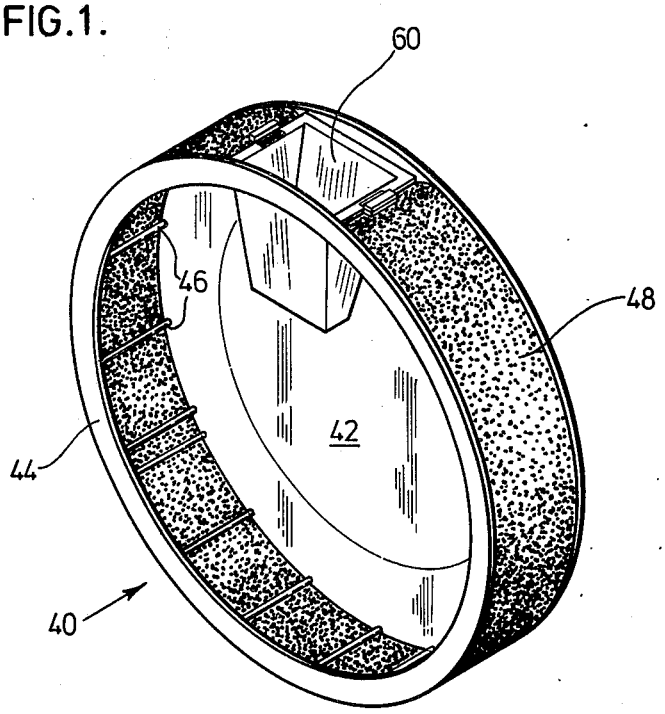
Figure 2:
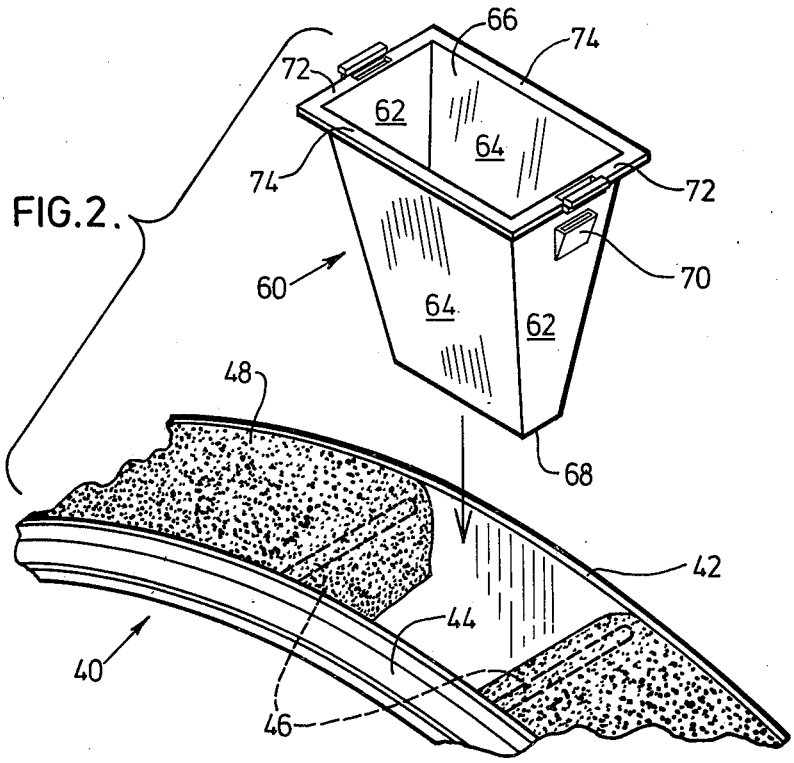
Figure 3:
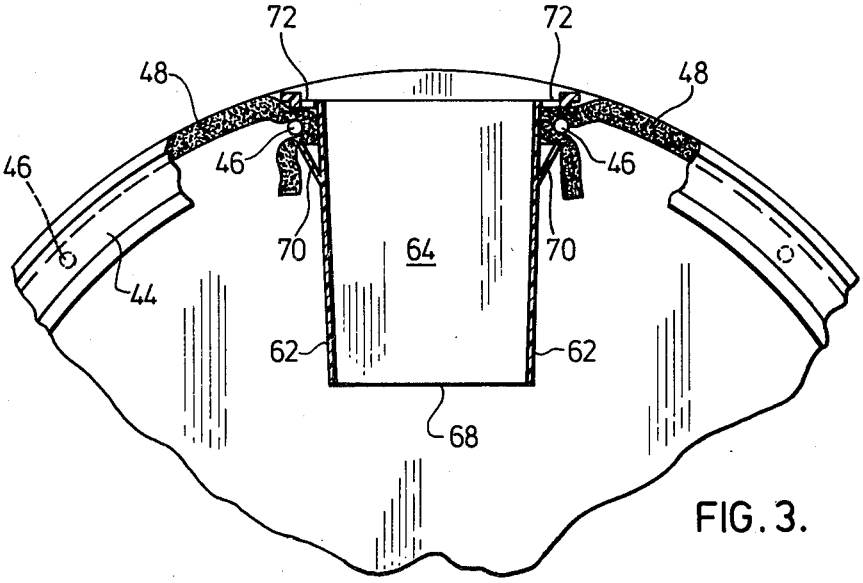
FIG. 3 shows in detail an end elevation partially in section of the drum of FIG. 1.

As thus far described, humidifier 10 is of a conventional nature. Referring now particularly to FIGS. 1–3, band 48 may be seen to occupy a major portion of the periphery of drum 40. The remaining portion of the periphery is occupied by a filler funnel 60. In its preferred, illustrated form, funnel 60 is generally a truncated rectangular pyramid shape and is comprised by a pair of inwardly inclining side walls 62 and a pair of inwardly inclining end walls 64. The base of the rectangular pyramid i.e. the mouth opening 66 of funnel 60, may conveniently be some 20–25 square inches, with the truncated end or spout 68 of the funnel narrowing to some 1–4 square inches. Rods 46 of drum 40 are generally equi-spaced apart around the periphery of drum 40 so that side walls 62 of funnel 60 are a loose interference fit when the funnel is positioned in drum 40 between any adjacent pairs of rods 46. When in position the funnel 60 will have its mouth opening generally in the periphery of the drum. Shoulders 70 are provided on side walls 62 which loosely engage behind respective adjacent rods 46 when funnel 60 is in position. Band 48 is open ended; the band is of such length that it just loops around the periphery of drum 40, and the ends of the band pass over adjacent rods to tuck into the interior of the drum. With band 48 so positioned, funnel 60 is inserted into the peripheral opening; each end of the band is compressed between a side wall 62 of the funnel, and a rod 46, and the shoulders 70 snap fit behind rods 46 to lock the funnel in place. Side walls 62 and end walls 64 of funnel 60 are overturned adjacent to mouth opening 66 at 72 and 74 respectively to form a supporting rim around the mouth opening. Rim portions 72 of funnel 60 act to compress and seal band 48 where it passes over underlaying rods 46. Whilst these rim portions are retained in compressing and sealing relationship by shoulders 70, other means of retention could equally well be employed as will be evident to those skilled in the art. Rim portions 74 are sized so as to generally interfere and generally seal with inwardly facing portion of wall 42 and flange 44 of the drum 40.

In replenishing the water reservoir of our improved humidifier, louvres 50 are first removed so as to expose the interior of plenum 18, and drum 40 is rotated so that the mouth 66 of funnel 60 is uppermost. Water from a bucket or other suitable recipient may then be poured at a high rate through funnel 60. Splashing tends to be contained by the internal structure of drum 40, and any water which is misdirected or which overflows from the mouth 66 of the funnel tends to be caught by band 48 and directed towards reservoir 30.

Figure 6:
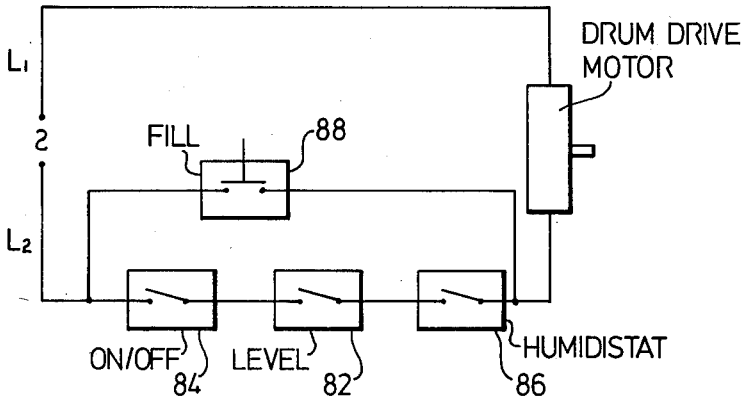
FIG. 6 shows in schematic a preferred switching arrangement for the humidifier of our invention.

Whilst typical dimensions have been given for the mouth opening 55 and spout opening 68 of funnel 60, it will be appreciated that these are not critical. In the design of funnel 60 there are several factors which are to be considered. Thus the funnel must be capable of passing water therethrough at a reasonably high rate, but at the same time it must be restrictive of the flow of air in the reverse direction, as any air lost through the funnel will reduce the efficiency of the humidifier. Our invention contemplates the use of a simple flap seal which may be placed in the mouth or the spout of funnel 60, and this would not require the spout size to be restricted. As a further factor however it is desirable that side walls 62 of funnel 60 taper inwardly in order to provide a lead for the insertion of the funnel walls between rods 46. As a still further consideration funnel 60 must direct water towards reservoir 30 whilst minimizing splashing. For this purpose funnel 60 may be constructed so as to direct water towards the solid backwall 42 of drum 40, although it is presently preferred that the funnel should be non-handed and capable of being inserted into the drum without the possibility of misdirecting the water. Drum 40 may be rotated manually without difficulty so as to position funnel 60 uppermost. However it may be preferred to employ the drum drive motor for this purpose. In certain models of humidifier the drive motor is placed in series with a water level switch, shown in FIG. 5 as 82. As the water level in reservoir 30 drops to a predetermined level, switch 82 opens to stop the drive motor. In still other models of humidifier a humidistat control switch may be placed in series with the drive motor. Either the level switch 82 or the humidistat, when open, will not permit the operation of the drum drive motor. In the circuit diagram of FIG. 6, the drum drive motor is shown as connected to a power source by first and second lines L1 and L2. Second line L2 is interrupted by an on/off or speed selector switch 84, the water level switch 82, and a humidistat switch 86, all of which are in series connection. In parallel connection therewith is placed a normally open momentary contact switch 88. Thus with any of the switches 82, 84, or 86 in an open circuit position, momentary contact switch 88 can be user operated so as to cause the drum drive motor to rotate until the funnel 60 is in its uppermost position. Desirably switch 84 and momentary contact switch 88 are ganged and have a centre off position so that the switches will be both normally placed in the off position subsequent to the momentary contact switch 88 having been employed, thereby avoiding an unanticipated movement of the drum 60 during the replenishment of the reservoir.

What I claim as new and desire to secure by Letters Patent of the United States is:

1. In a portable air humidifier comprising a drum having a skeletal frame periphery, a belt of air permeable, water absorbent material generally covering said periphery, a water reservoir, said drum being mounted for rotation with peripheral portions thereof within said reservoir, the improvement wherein a major portion of said periphery is covered by said belt, the remaining minor portion of said periphery defining an opening to the interior of said drum, and wherein a funnel means is provided having wall structure defining the mouth opening of said funnel and a discharge spout therefor, said funnel means being generally secured to said drum with said mouth opening coincident with said opening and said spout directed towards the interior of said drum whereby replenishing water may be added to said reservoir.

2. The humidifier of claim 1 wherein said belt is open ended and wherein a first end is retained in position by compression between the wall structure of said funnel and said skeletal frame.

3. The humidifier of claim 2 wherein the other end of said belt is retained in position by compression between the wall structure of said funnel and said skeletal frame.

4. The humidifier of claim 1 wherein said skeletal frame comprises a plurality of equi-spaced axially aligned rods, said funnel being proportioned to be received between adjacent rods in loose wedging engagement.

5. The humidifier of claim 4 wherein shoulder means are provided on said funnel, said shoulder means engaging behind said rods when said funnel is positioned.

6. The humidifier of claim 4 wherein said belt is open and wherein the ends thereof are sandwiched between respective wedging portions of said funnel and said rods.

7. The humidifier of claim 4 wherein said funnel is shaped as a truncated rectangular pyramid.

8. The humidifier of claim 7 wherein wall portions of said funnel defining the mouth opening thereof are outwardly turned to lie generally in the periphery of said drum when said funnel is positioned.

9. The humidifier of claim 1 including electric motor means for rotating said drum, automatic switch means for interrupting current to said motor means responsive to a low water level in said reservoir, first manual ON-OFF switch means in series connection with said automatic switch means and second manual ON-OFF switch means in parallel connection with said first manual switch means and said automatic switch means for overriding said first manual switch means and said automatic switch means.

10. The humidifier of claim 9 wherein said first and said second manual switch means are coupled together such that said second manual switch means is operable to the ON position only when said first manual switch means is in the OFF position.

11. The humidifier of claim 10 wherein said second manual switch means comprises a momentary ON switch.

* * * * *